US009175840B2

(12) United States Patent
Patti

(10) Patent No.: US 9,175,840 B2
(45) Date of Patent: Nov. 3, 2015

(54) LED WALL LIGHT FIXTURE

(71) Applicant: EVENING STAR LIGHTING, INC., Glen Cove, NY (US)

(72) Inventor: Anthony Patti, Highland Park, NJ (US)

(73) Assignee: EVENING STAR LIGHTING INC., Glen Cove, NY (US)

( * ) Notice: Subject to any disclaimer, the term of this patent is extended or adjusted under 35 U.S.C. 154(b) by 119 days.

(21) Appl. No.: 14/212,465

(22) Filed: Mar. 14, 2014

(65) Prior Publication Data

US 2014/0268774 A1 Sep. 18, 2014

Related U.S. Application Data

(60) Provisional application No. 61/799,798, filed on Mar. 15, 2013.

(51) Int. Cl.

| | |
|---|---|
| ***F21S 4/00*** | (2006.01) |
| ***F21V 27/02*** | (2006.01) |
| ***F21S 8/00*** | (2006.01) |
| *F21V 31/00* | (2006.01) |
| *F21Y 101/02* | (2006.01) |
| *F21Y 103/00* | (2006.01) |

(52) U.S. Cl.

CPC ..... *F21V 27/02* (2013.01); *F21S 8/036* (2013.01); *F21S 4/008* (2013.01); *F21S 8/033* (2013.01); *F21V 31/005* (2013.01); *F21Y 2101/02* (2013.01); *F21Y 2103/003* (2013.01)

(58) Field of Classification Search

CPC ..... F21S 8/036; F21S 8/033; F21S 4/008; F21V 27/02; F21V 19/003–19/0055; F21Y 2103/003

USPC ..... 362/249.02, 219, 221

See application file for complete search history.

(56) References Cited

U.S. PATENT DOCUMENTS

| | | | |
|---|---|---|---|
| 1,853,321 | A | 4/1932 | Rogers |
| 2,038,506 | A | 4/1936 | Cadieux |
| 3,007,034 | A | 10/1961 | Reed et al. |
| 3,824,524 | A | 7/1974 | Glover |
| 4,223,377 | A | 9/1980 | Williams |
| 4,382,274 | A | 5/1983 | De Backer et al. |
| 4,396,972 | A | 8/1983 | Kaneko et al. |

(Continued)

FOREIGN PATENT DOCUMENTS

| | | |
|---|---|---|
| CA | 2492501 | 7/2005 |
| CA | 2591736 | 12/2007 |
| CA | 2654119 | 8/2009 |

OTHER PUBLICATIONS

Product Sheet from Cast Lighting LLC for Cast Engineered Wall Light Product Information (CEWL5CB) 1 page. Copyright 2008.

(Continued)

*Primary Examiner* — Robert May
*Assistant Examiner* — Bryon T Gyllstrom
(74) *Attorney, Agent, or Firm* — Greenberg Traurig, LLP

(57) ABSTRACT

A light fixture includes a lamp assembly having a housing containing a plurality of light sources. The light fixture further includes a lamp holder having a substantially flat body, a flange extending in a substantially diagonal orientation out of the plane of said substantially flat body, and a pair of side attaching members. The light fixture further includes a skirt having a face plate and a pair of stop members extending substantially perpendicular to the face plate.

1 Claim, 10 Drawing Sheets

(56) References Cited

U.S. PATENT DOCUMENTS

| | | | | |
|---|---|---|---|---|
| 4,449,167 | A | 5/1984 | Cohen | |
| 4,635,167 | A | 1/1987 | Schlosser | |
| 4,697,950 | A | 10/1987 | Copeland | |
| 4,700,277 | A | 10/1987 | Moore | |
| D293,133 | S | 12/1987 | Wood | |
| 4,744,014 | A | 5/1988 | Harris | |
| 4,779,324 | A | 10/1988 | Sandor, Sr. | |
| 4,851,977 | A | 7/1989 | Gary | |
| 4,888,669 | A | 12/1989 | Hanson | |
| 4,912,610 | A | 3/1990 | Dahlberg | |
| 4,931,915 | A | 6/1990 | Quiogue | |
| 4,974,134 | A | 11/1990 | Bourne | |
| 4,992,914 | A | 2/1991 | Heiss et al. | |
| 5,029,054 | A | 7/1991 | Trainor | |
| D328,502 | S | 8/1992 | Hartman | |
| 5,156,454 | A | 10/1992 | White | |
| 5,160,202 | A | 11/1992 | Legare | |
| 5,249,108 | A | 9/1993 | Gary | |
| 5,335,151 | A | 8/1994 | Dahlberg | |
| 5,363,092 | A * | 11/1994 | Starchevich | 340/473 |
| 5,390,090 | A | 2/1995 | Nau | |
| 5,481,443 | A | 1/1996 | Wagner et al. | |
| 5,575,098 | A * | 11/1996 | Goettel-Schwartz | 40/550 |
| D376,657 | S | 12/1996 | Bohn | |
| 5,678,920 | A | 10/1997 | Kerr | |
| 5,683,170 | A | 11/1997 | Blaha | |
| 5,743,622 | A | 4/1998 | Ibbitson et al. | |
| 5,778,625 | A | 7/1998 | Druffel et al. | |
| 5,779,349 | A | 7/1998 | Reinert, Sr. | |
| 5,908,263 | A | 6/1999 | Conners et al. | |
| 5,924,790 | A | 7/1999 | Ponton et al. | |
| 5,943,827 | A | 8/1999 | Okerlund | |
| 5,951,144 | A | 9/1999 | Gavigan et al. | |
| 6,027,280 | A | 2/2000 | Conners et al. | |
| 6,065,853 | A | 5/2000 | Crevier | |
| 6,068,384 | A | 5/2000 | Tyson et al. | |
| 6,113,248 | A * | 9/2000 | Mistopoulos et al. | 362/240 |
| 6,135,625 | A * | 10/2000 | Kodaira et al. | 362/476 |
| 6,179,435 | B1 | 1/2001 | Wilson | |
| 6,231,206 | B1 | 5/2001 | Hervey et al. | |
| 6,334,695 | B1 | 1/2002 | Abe et al. | |
| 6,431,728 | B1 * | 8/2002 | Fredericks et al. | 362/244 |
| 6,547,589 | B2 | 4/2003 | Magyar et al. | |
| 6,565,239 | B2 | 5/2003 | Rizkin et al. | |
| 6,578,321 | B2 | 6/2003 | Layne | |
| 6,648,546 | B1 | 11/2003 | Abe et al. | |
| 6,665,986 | B1 | 12/2003 | Kaplan | |
| 6,796,684 | B1 | 9/2004 | Beadle | |
| 6,866,032 | B2 | 3/2005 | Magyar et al. | |
| 6,866,394 | B1 * | 3/2005 | Hutchins et al. | 362/192 |
| 6,881,094 | B2 | 4/2005 | Magyar et al. | |
| 6,976,765 | B2 | 12/2005 | Helenowski | |
| 7,033,038 | B2 | 4/2006 | Hagen | |
| 7,048,419 | B1 * | 5/2006 | Rodriguez | 362/485 |
| 7,070,294 | B2 | 7/2006 | Patti | |
| 7,182,637 | B2 * | 2/2007 | Coyle et al. | 439/557 |
| 7,234,846 | B2 | 6/2007 | Chen | |
| 7,290,904 | B2 | 11/2007 | Miller | |
| D564,128 | S | 3/2008 | Hartman | |
| D570,037 | S | 5/2008 | Hartman | |
| D574,106 | S | 7/2008 | Hartman | |
| D576,763 | S | 9/2008 | Hartman | |
| 7,524,077 | B2 | 4/2009 | Hartman | |
| 7,556,394 | B2 | 7/2009 | Patti | |
| 7,980,863 | B1 * | 7/2011 | Holec et al. | 439/67 |
| 8,002,447 | B2 * | 8/2011 | Patti | 362/382 |
| 8,066,398 | B2 | 11/2011 | Hartman | |
| D651,336 | S | 12/2011 | Hartman | |
| 8,827,518 | B2 * | 9/2014 | Smith et al. | 362/497 |
| 2003/0048634 | A1 | 3/2003 | You et al. | |
| 2003/0156405 | A1 | 8/2003 | Kim | |
| 2004/0252489 | A1 | 12/2004 | Hagen | |
| 2005/0270774 | A1 * | 12/2005 | Pan | 362/217 |
| 2006/0114680 | A1 | 6/2006 | Miller | |
| 2007/0263396 | A1 | 11/2007 | Miller | |
| 2008/0062679 | A1 | 3/2008 | Hartman | |
| 2009/0213580 | A1 | 8/2009 | Hartman | |

OTHER PUBLICATIONS

"Product Update", Vista Professional Outdoor Lighting, 1 page, published prior to Jul. 9, 2007.

Product Sheet from HUMZA Productions, Ltd., Auckland, New Zealand, 1 page, undated.

Newsletter, "Landscape Lifestyles". No. 7, copyright 2005, Allan Block Corporation, MN, 6pp. viewed on Mar. 10, 2008 at <http://www.allanblock.com/retainingwalls/newsletter/.

Photograph of light fixture by Integral Lighting, Wernersville, PA, bottom view, undated.

* cited by examiner

LED WALL LIGHT FIXTURE

CROSS-REFERENCE TO RELATED APPLICATIONS

This application is a Section 111(a) application relating to and claiming the benefit of commonly owned, U.S. Provisional Patent Application No. 61/799,798 filed Mar. 15, 2013, which is incorporated by reference herein in its entirety.

BACKGROUND OF THE INVENTION

Light fixtures mounted on retaining walls or under steps, decks or railings are known in the art. Building codes and restrictions on the amount of reveal (i.e., overhang or protrusion) limit the types and designs of light fixtures that may be placed in these areas. With many of these fixtures, removal and replacement of the bulbs can be difficult, requiring that the bulb covers or the fixtures themselves be removed so that the bulbs can be accessed. The process of removing the bulbs presents a risk of burns or electrical shocks. Water drainage or condensation may penetrate the bulb cover, thereby damaging the electrical components, increasing the risk of electrical shocks or failure of the lamp. Further, many of the known light fixtures are configured to direct light downwards, thereby providing only narrow fields of illumination. Such fixtures may produce shadows or hot spots of intense light, which can be aesthetically displeasing.

SUMMARY OF THE INVENTION

A light fixture including a modular lamp assembly having a sealed housing, the sealed housing including a circuit board with electrical contacts configured to provide electrical power to a plurality of light emitting diode (LED) lights connected thereto, wherein the circuit board is electrically connected to an electrical cord with wires contained therein. The light fixture further includes a lamp holder having a substantially flat body, a flange extending out of a plane wherein the substantially flat body lies such that the flange is oriented substantially diagonal thereto. The flange includes an opening and an electrical grommet configured to allow passage of the electrical cord, and a pair of side attachment members with threaded openings, the pair of side attachment members extending out of the plane where the substantially flat body lies such that the pair of side attachment members is oriented substantially diagonal thereto. The light fixture further comprises a skirt having a face plate and a pair of stop members extending substantially perpendicular to the face plate, the face plate having threaded openings that align with the threaded openings of the attachment members of the lamp holder.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE DRAWINGS

U.S. Pat. No. 8,002,447 entitled SURFACE-MOUNTED LIGHTING FIXTURE issued on Aug. 23, 2011, and U.S. Provisional Patent Application No. 61/065,982 entitled LIGHTING FIXTURE FOR RETAINING WALL, filed Feb. 15, 2008 are hereby incorporated by reference herein in their entireties.

Figure 1:
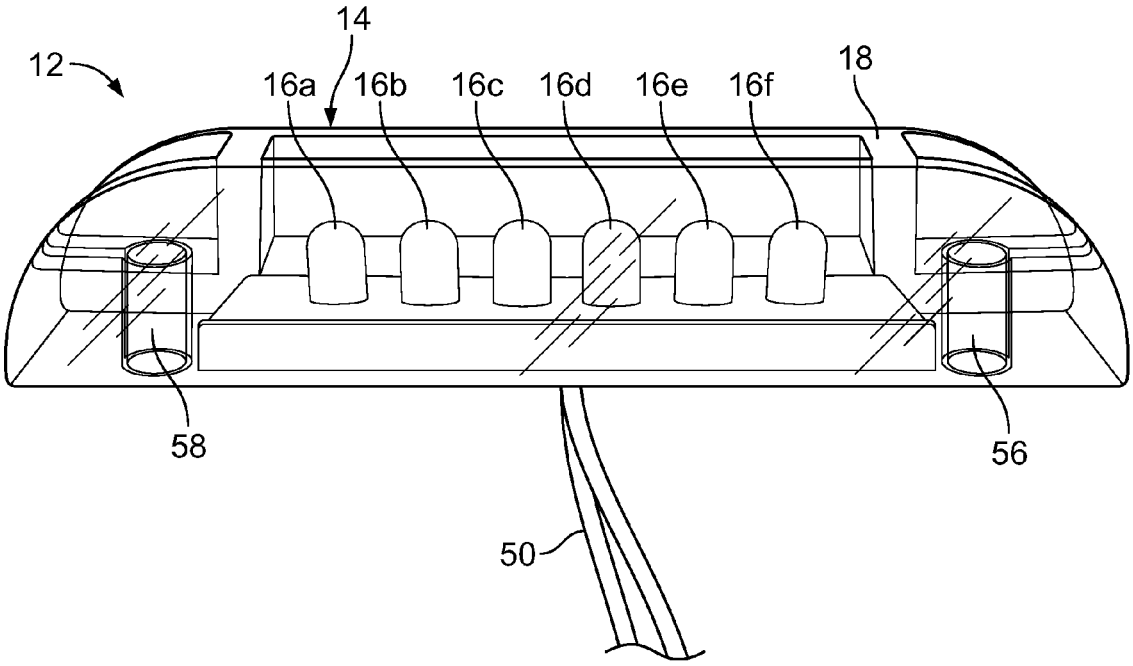
FIG. 1 is a bottom elevational view of a modular lamp assembly of a light fixture constructed in accordance with a first exemplary embodiment of the present invention.
Figure 2:
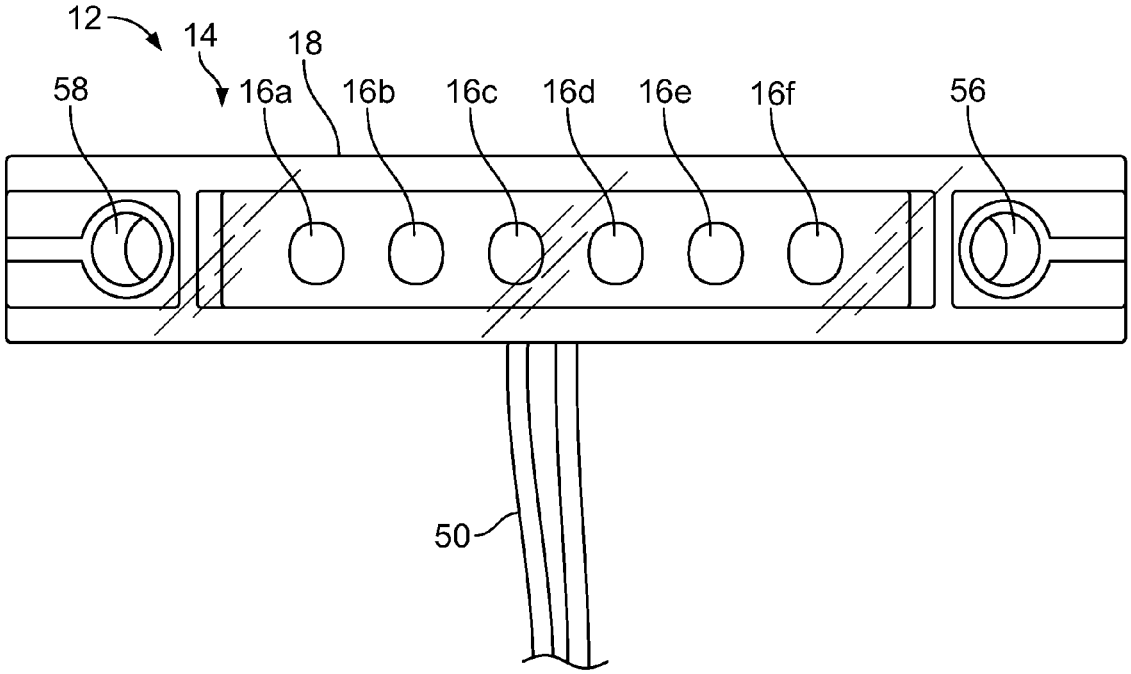
FIG. 2 is a front elevational view of the modular lamp assembly of the light fixture shown in FIG. 1.
Figure 3:
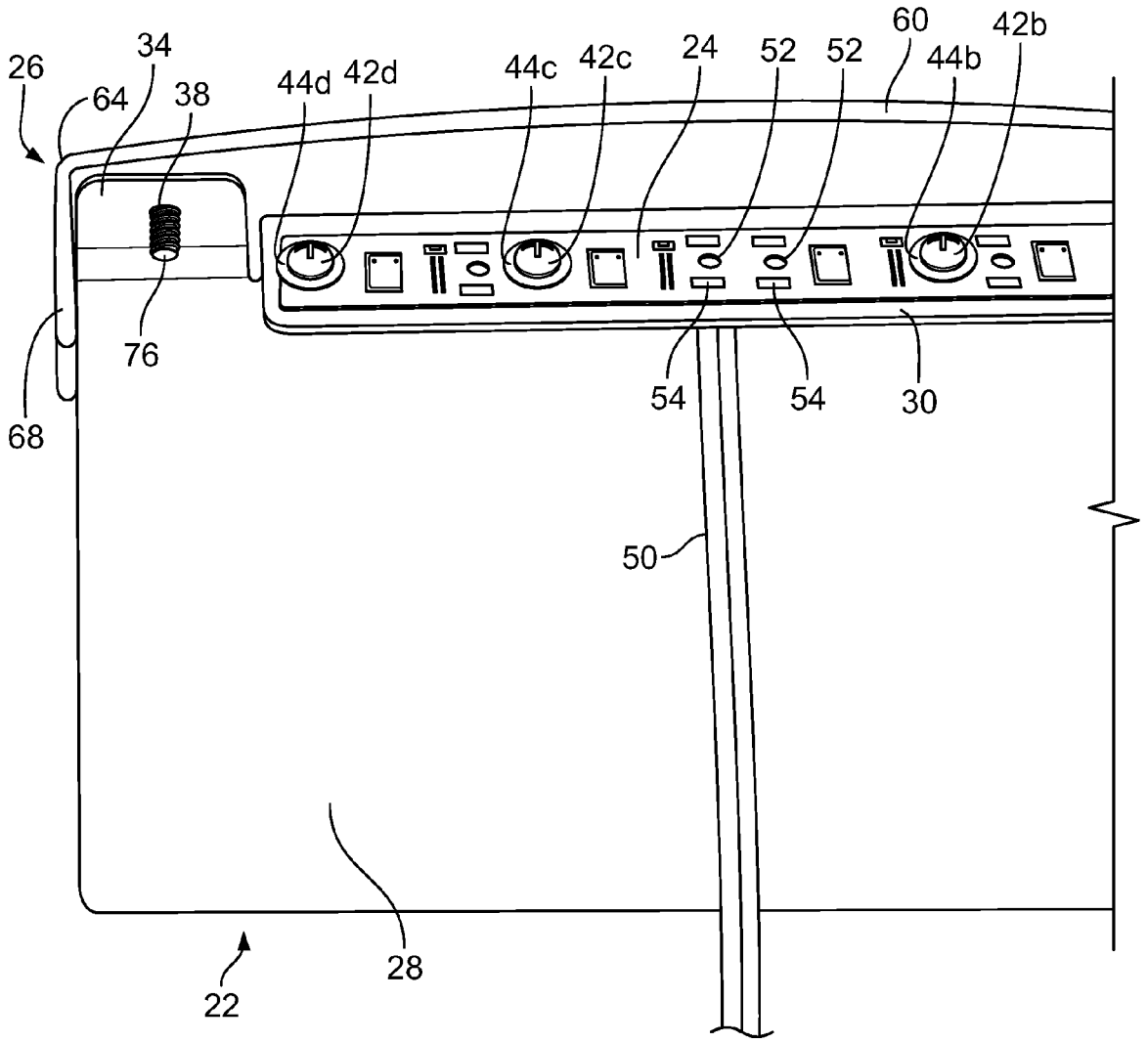
FIG. 3 is a bottom elevational view of a portion of a lamp holder associated with the light fixture shown in FIG. 1.
Figure 4:
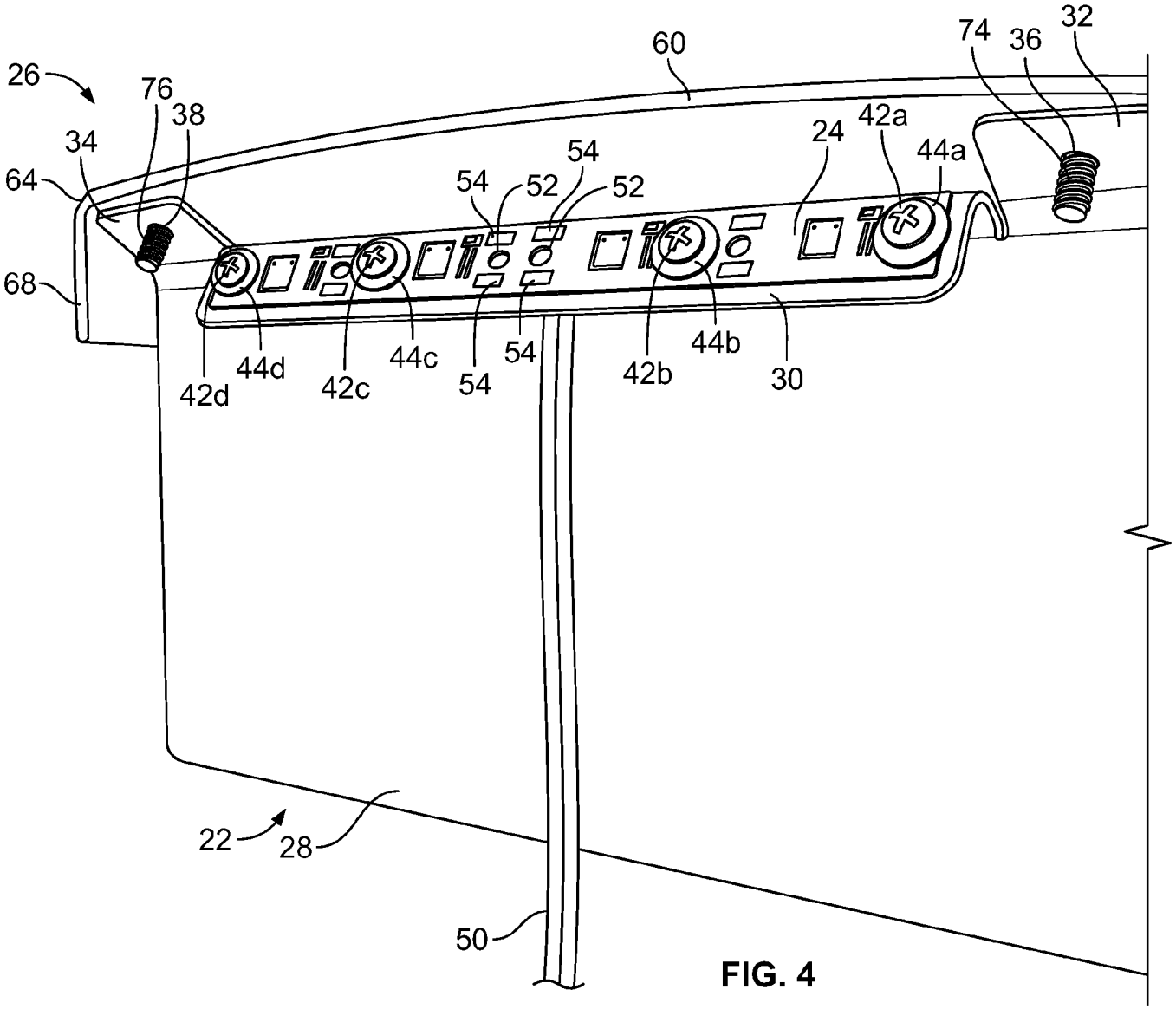
FIG. 4 is a bottom perspective view of the lamp holder shown in FIG. 3.
Figure 5:
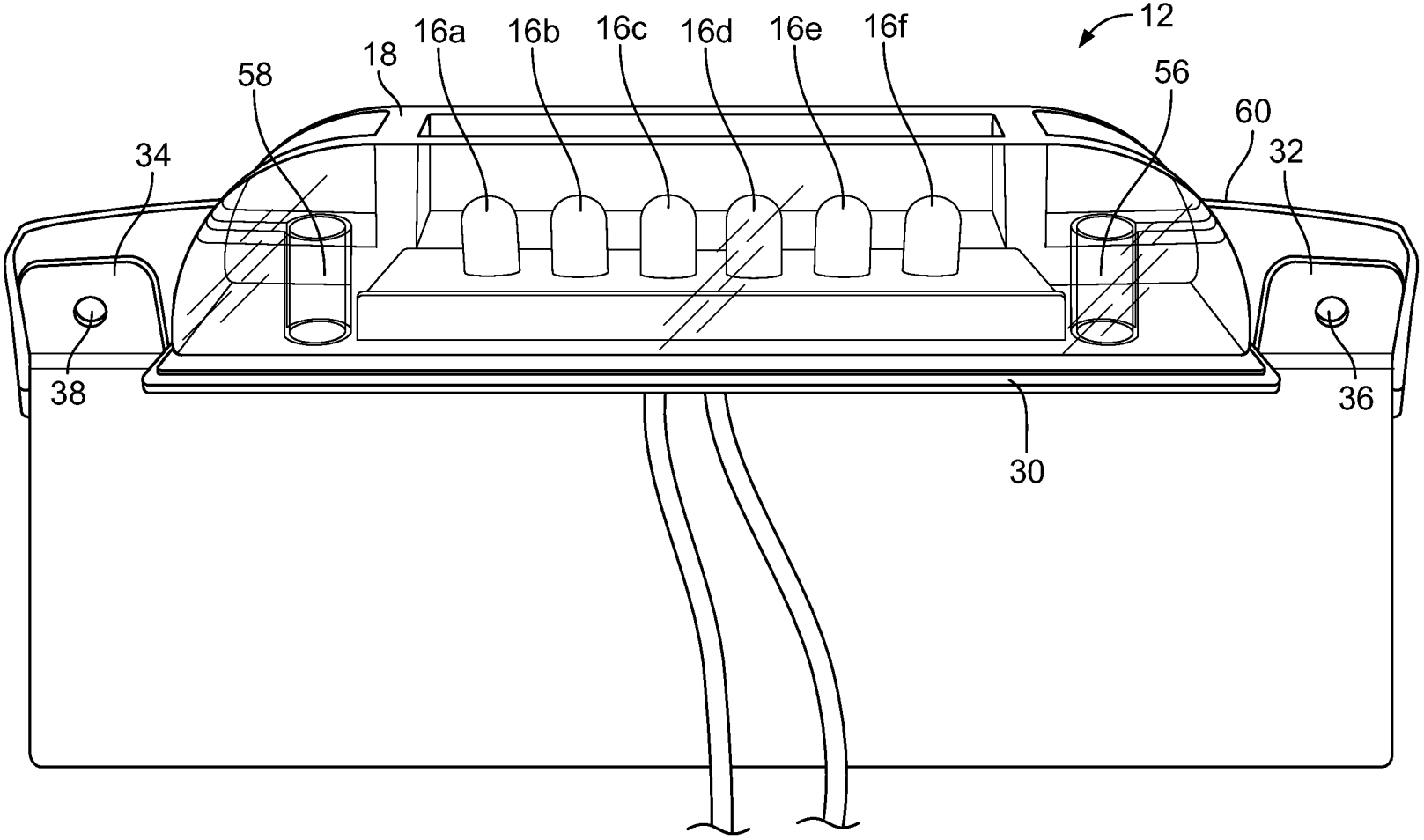
FIG. 5 is a bottom elevational view of the modular lamp assembly of the light fixture shown in FIG. 1, with an illuminating element being attached to a flange of the lamp holder shown in FIG. 3.

FIGS. 1-12 depict a light fixture 10 constructed in accordance with a first exemplary embodiment of the present invention. Referring to FIGS. 1 and 2, a light fixture 10 includes a modular lamp assembly 12 having a housing 14 that is adapted to accommodate one or more self-contained light sources. In an embodiment, the housing 14 is adapted to accommodate one or more light emitting diode (LED) light bulbs 16*a*, 16*b*, 16*c*, 16*d*, 16*e*, 16*f*. The housing 14 includes a light transmitting cover 18, which may be transparent or translucent, clear or colored, and may contain optical elements (e.g., mirrors) to distribute light from the light sources in a desired pattern. The cover 18 may be made of any of a number of light-transmitting materials, such as acrylic or an impact-resistant polycarbonate plastic such as LEXAN®.

Figure 6:
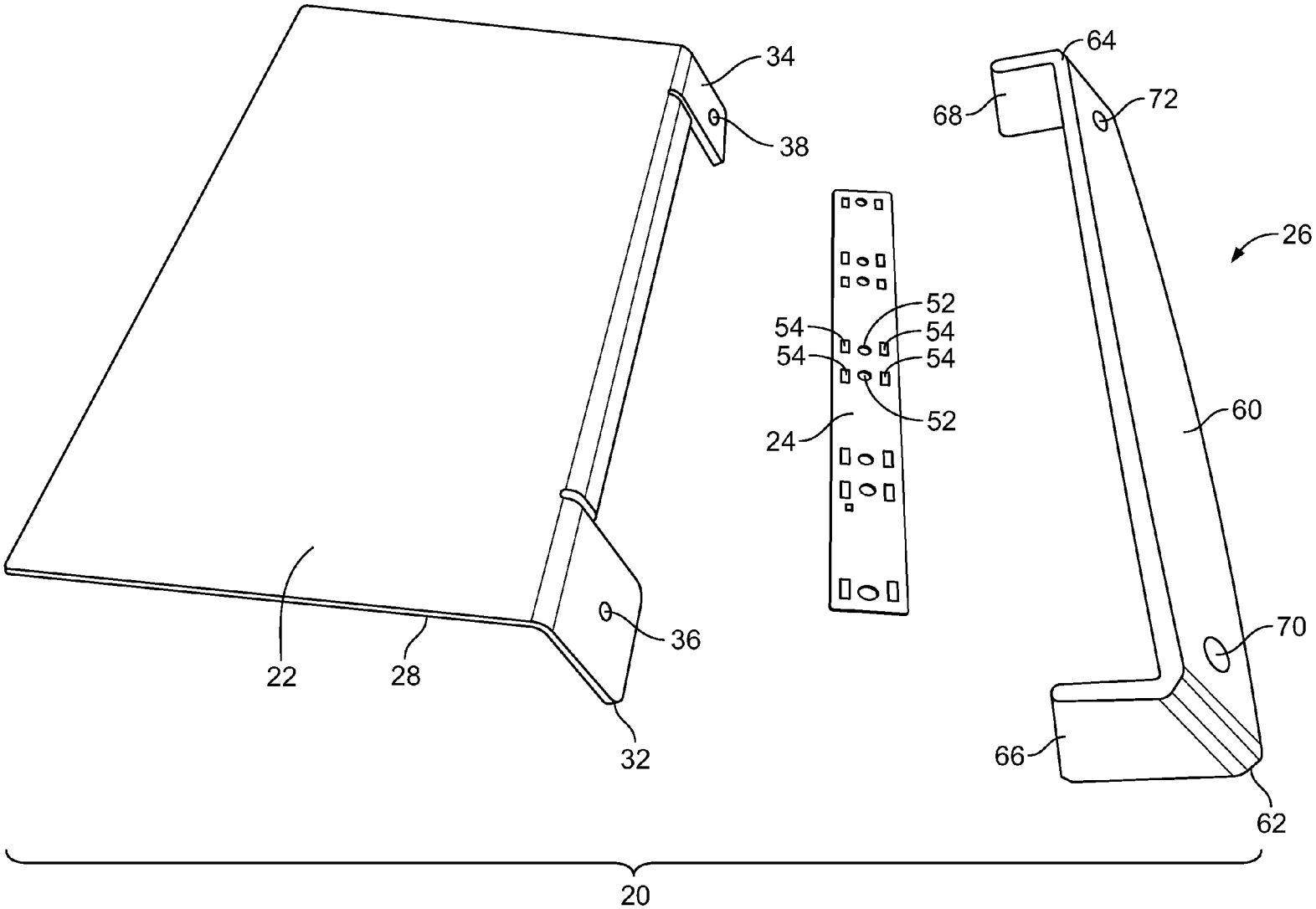
FIG. 6 is an exploded view of the lamp holder shown in FIG. 3 and a skirt.
Figure 7:
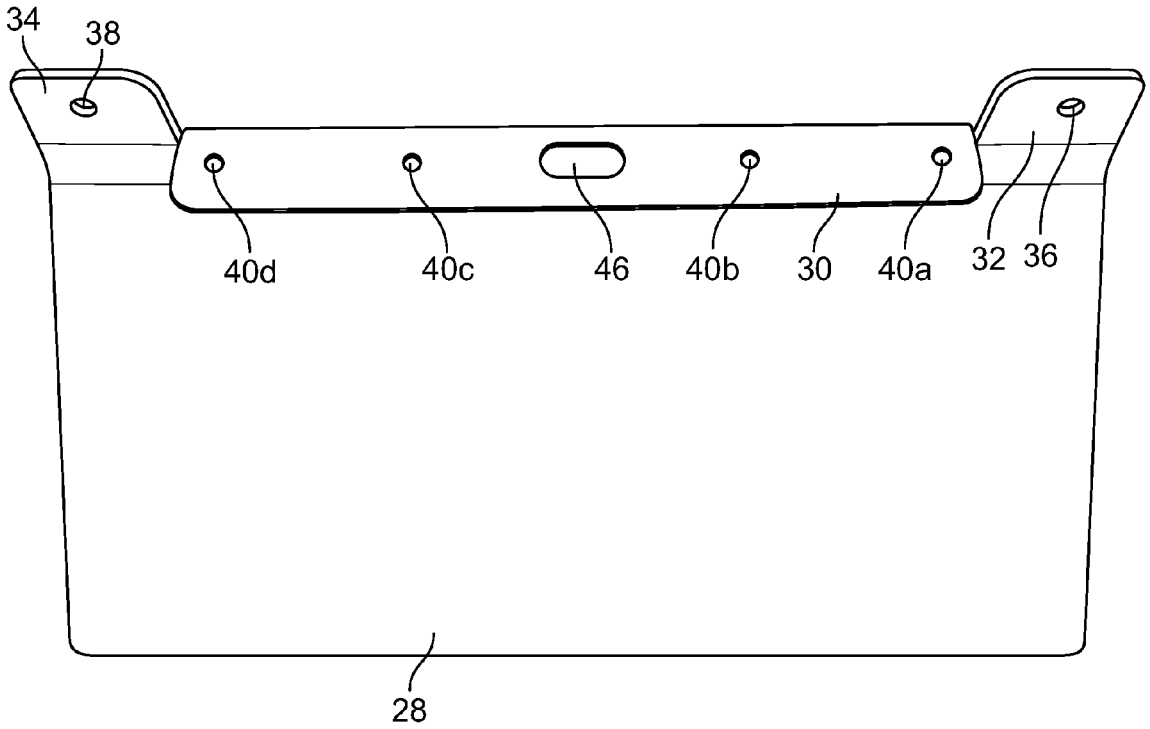
FIG. 7 is a bottom elevational view of a flange of the lamp holder shown in FIG. 3.
Figure 8:
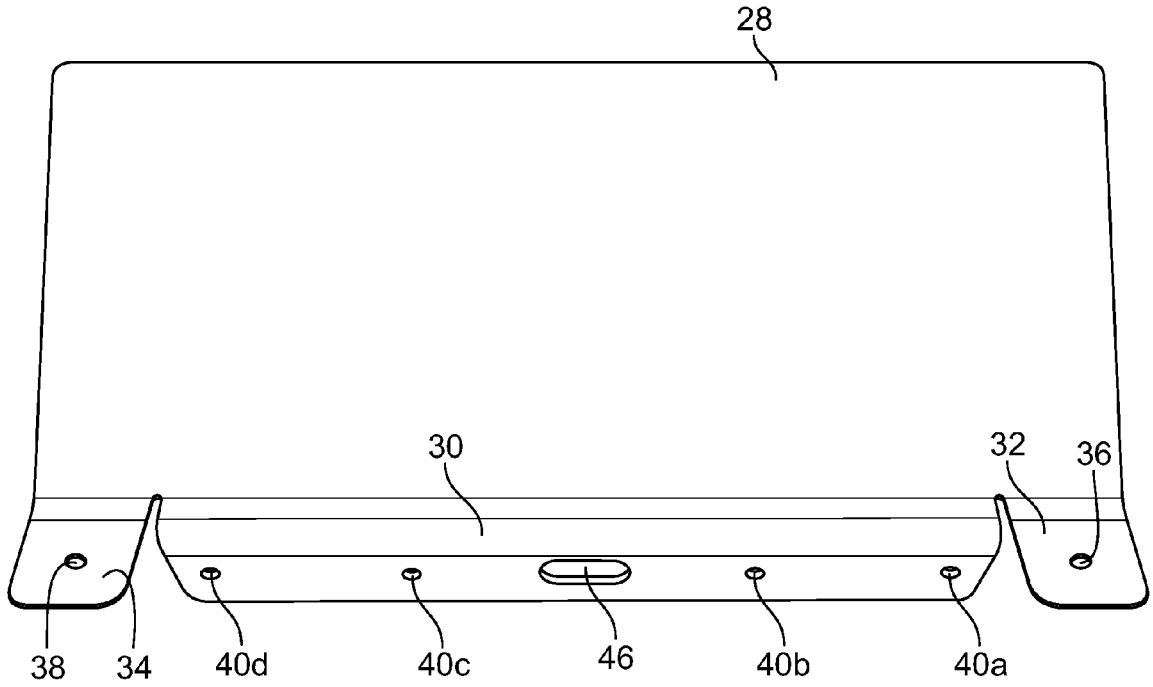
FIG. 8 is a top perspective view of the flange shown in FIG. 7.

As depicted in FIG. 6, the light fixture 10 includes an attachment module 20 having a lamp holder 22, a circuit board 24, and a skirt 26. Referring now to FIGS. 3-6, the lamp holder 22 includes a substantially flat body 28 and a lamp holder flange 30 extending out of the plane of where the flat body 28 lies and positioned at the front end thereof (see FIG. 6). The flange 30 may be angled downward from the flat body 28 so as to be oriented substantially diagonal thereto. The lamp holder 22 also includes side attaching members 32, 34 that extend out of a plane where the flat body 28 lies and are angled downward from the flat body 28 so as to be oriented substantially diagonal thereto and substantially perpendicular to the flange 30. The attaching members 32, 34 include openings 36, 38, which may be threaded. In an embodiment, the flange 30 also includes four threaded openings 40*a*, 40*b*, 40*c*, 40*d* (see FIGS. 7 and 8) via which the circuit board 24 is mounted to the flange 30 by screws 42*a*, 42*b*, 42*c*, 42*d* (see FIGS. 4 and 9) and insulating washers 44*a*, 44*b*, 44*c*, 44*d* (see FIGS. 4 and 9). More or fewer threaded openings may be provided as needed to securely attach circuit board 24 to the flange 30.

Figure 9:
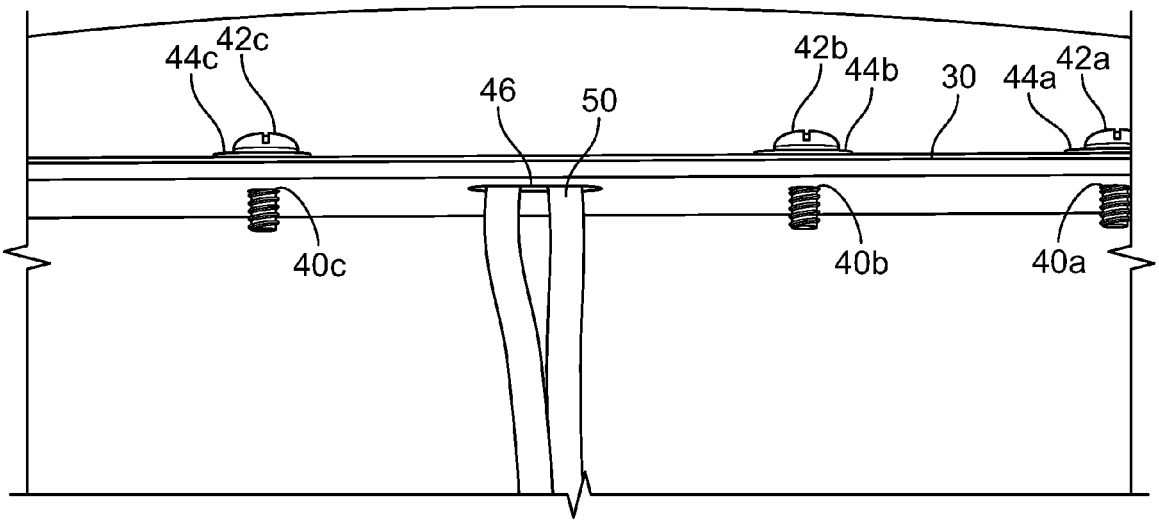
FIG. 9 is partial bottom elevational view of the flange shown in FIG. 7.

Referring now to FIGS. 6-9, the flange 30 includes an electrical cord opening 46 that is sized and shaped to receive an elastic grommet (not shown) through which an electrical cord 50 with wires contained therein (not shown) may pass (see FIG. 9). While opening 46 is depicted with an oval shape, any suitable shape may be provided which can accommodate the elastic grommet. The elastic grommet is sized and shaped such that it may be fitted snugly into the opening 46 and may also allow the electrical cord 50 to pass through it. The circuit board 24 includes wire openings 52 and a plurality of electrically conductive elements 54 (see FIGS. 6 and 10) and is configured to be fixedly attached to the flange 30. Referring in particular to FIG. 9, in an embodiment, electrical cord 50 is electrically connected to two of the plurality of electrically conductive elements 54 of the circuit board 24 via the wire openings 52 by any suitable method of electrical connection known in the art such as, for example, soldering. Various suitable means of connecting the light fixture 10 to a source of electrical power (not shown), such as electrical plugs, batteries, or power taps, will be apparent to persons having ordinary skill in the art.

The circuit board 24 is housed within the housing 14 of the modular lamp assembly 12, which is attached to the flange 30 over the circuit board 24 by any suitable method known in the art. In an embodiment, the housing 14 is provided with openings 56, 58 which correspond to the threaded openings 40*a*, 40*d* and thereby allow attachment of the housing 14 to the flange 30 by the screws 42*a*, 42*d*, respectively. The housing 14 of the modular lamp assembly 12 is sealed to the flange 30 to prevent liquids or water vapor from entering the housing 14. Sealing can be accomplished by any suitable sealing method known in the art, such as, for example, employing a silicone gasket (not shown). In an embodiment, each of the LED light bulbs 16*a*, 16*b*, 16*c*, 16*d*, 16*e*, 16*f* is electrically connected to two of the plurality of electrically conductive elements 54 of the circuit board 24 within the housing 14 so as to provide electric power to the LED light bulbs 16*a*, 16*b*, 16*c*, 16*d*, 16*e*, 16*f*.

Referring now to FIGS. 3-6, the skirt 26 is provided with a face plate 60 having a first end 62 and a second end 64 opposite the first end 62. Stop members 66, 68 are provided at the first and second ends 62, 64. The stop members 66, 68 extend out of the plane of the face plate 60 and may be substantially perpendicular thereto. In an embodiment, the skirt 26 is provided with openings 70, 72, which may be attached to the attaching members 32, 34 (see FIG. 6) through the threaded openings 36, 38, by fasteners, such as screws 74, 76 (see FIG. 4) inserted through the openings 70, 72 and corresponding threaded openings 36, 38. Other embodiments may employ other suitable attaching mechanisms known in the art, such as adhesives. In the depicted embodiment, the attaching members 32, 34 are angled substantially downward from the flat body 28 so that the skirt 26 is angled downward to form a generally diagonal angle relative to the ground.

Figure 10:
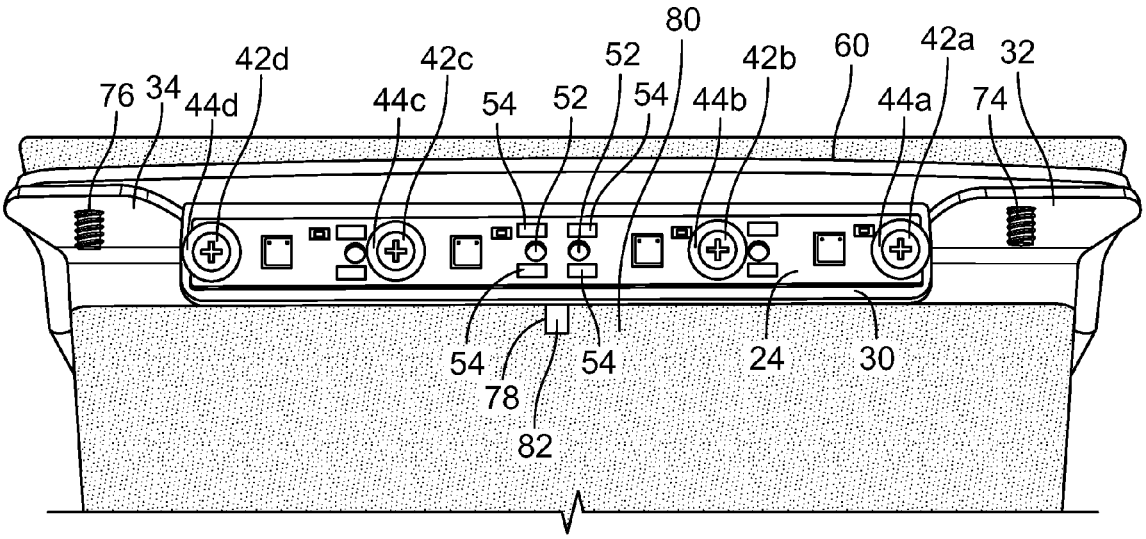
FIG. 10 is a bottom perspective view of a portion of the light fixture shown in FIG. 1 illustrating a circuit board used in the lamp holder shown in FIG. 3, the light fixture being positioned in wall blocks.
Figure 11:
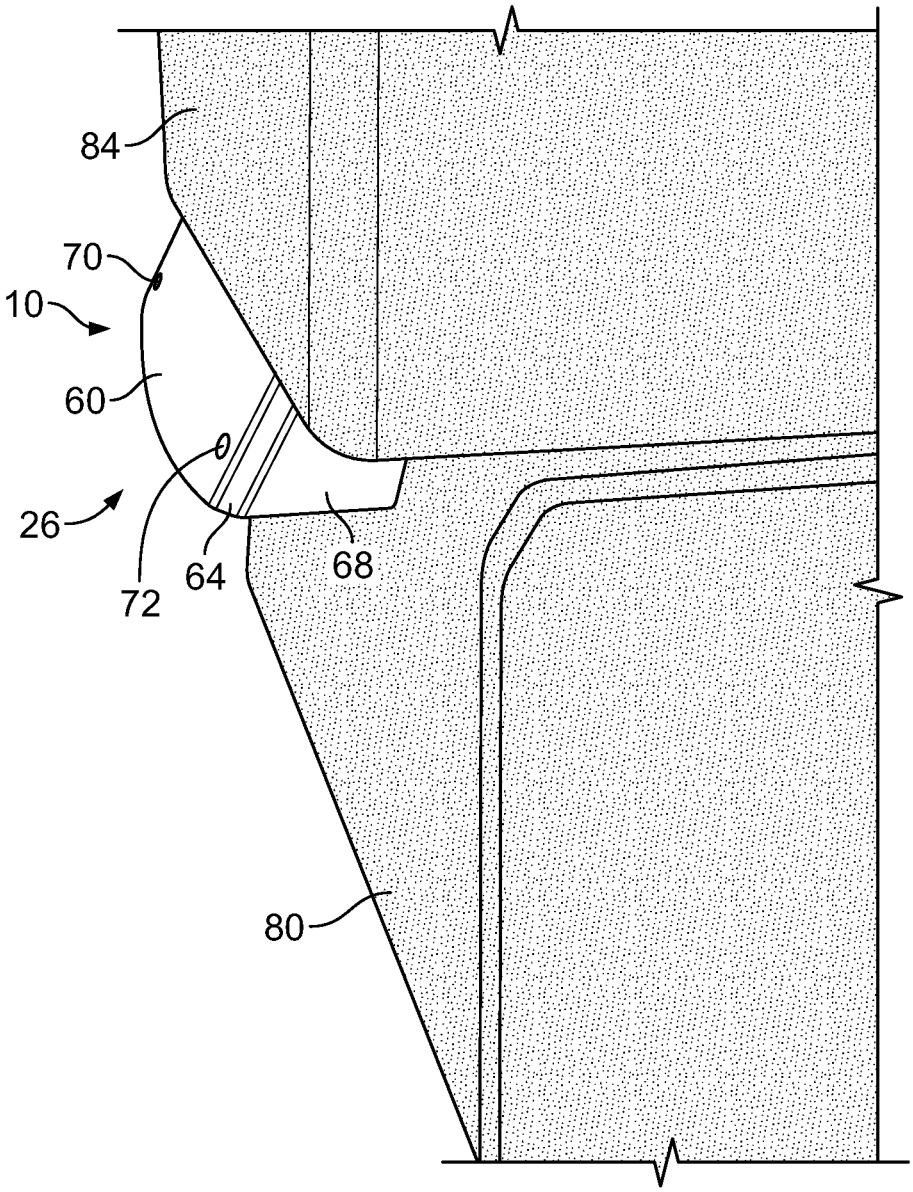
FIG. 11 is a front perspective view of a portion of a light fixture being positioned in wall blocks.
Figure 12:
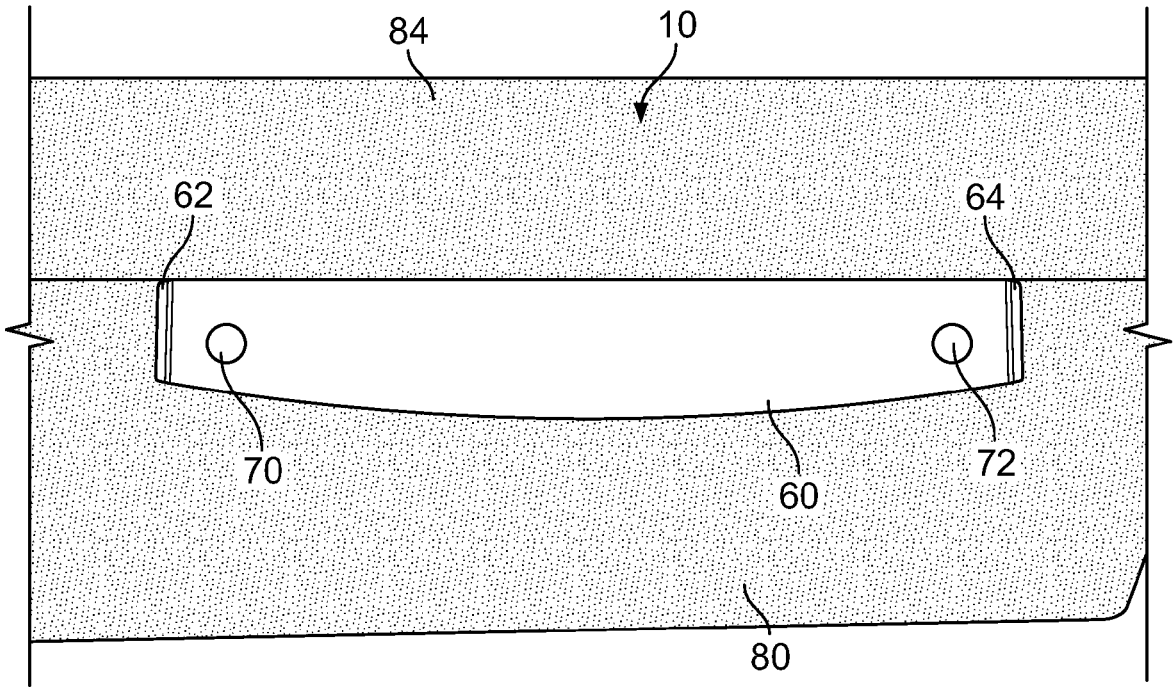
FIG. 12 is a front elevational view of the light fixture shown in FIG. 11 being positioned in wall blocks.

Referring to an embodiment of FIGS. 10-12, the skirt 26 is sized and shaped to conceal the attaching members 32, 34 and a substantial portion of the cover 18 of the light fixture 10. In some embodiments of the skirt 26, the face plate 60 and the stop members 66, 68 are opaque. In other embodiments, the skirt 26, the face plate 60 and stop members 66, 68 are made of a material that transmits light and, in yet further embodiments, may also be provided with optical or dichroic lenses. The face plate 60 or stop members 66, 68 may be painted, embossed, debossed or textured, or provided with other surface treatments.

The construction and operation of an embodiment of the present invention is described hereinbelow in relation to the exemplary embodiment of the light fixture 10. With reference to FIGS. 3-9, the circuit board 24 is installed on the flange 30 of the lamp holder 22 using the threaded openings 40*a*, 40*b*, 40*c*, 40*d* with the screws 42*a*, 42*b*, 42*c*, 42*d* and the insulating washers 44*a*, 44*b*, 44*c*, 44*d*. The electrical cord 50 is attached to two of the plurality of electrically conductive elements 54 of the circuit board 24 through the opening 46 such that the circuit board 24 can provide electricity to the LED light bulbs 16*a*, 16*b*, 16*c*, 16*d*, 16*e*, 16*f*. The skirt 26 and the housing 14 are connected to the lamp holder 22 in a fluid-tight manner such that the bulbs 16*a*, 16*b*, 16*c*, 16*d*, 16*e*, 16*f* are provided with electricity. In an embodiment, the threaded openings 40*a*, 40*d* of the circuit board 24 correspond to the openings 56, 58 of the housing 14 and utilize the same screws 44*a*, 44*d*, respectively, for fixed attachment.

With reference to FIGS. 10-12, a groove 78 is cut into a wall block 80 to provide a channel 82 for the electrical cord 50. The groove 78 is positioned in the center of the wall block 80 to allow the electrical cord 50 to enter the opening 46 in the flange 30. The flat body 28 of the fixture 10 is inserted into a space (not shown) between the wall block 80 and a wall block 84, and the electrical cord 50 is connected to an electrical source (not shown). The skirt 26 is angled outward from the wall block 84, in accordance with the design of the light fixture 10, as has been discussed herein. While one method of construction and operation of the present invention has been described, it should not be viewed as limiting the manner in which the present invention may be constructed and operated.

Figure 13:
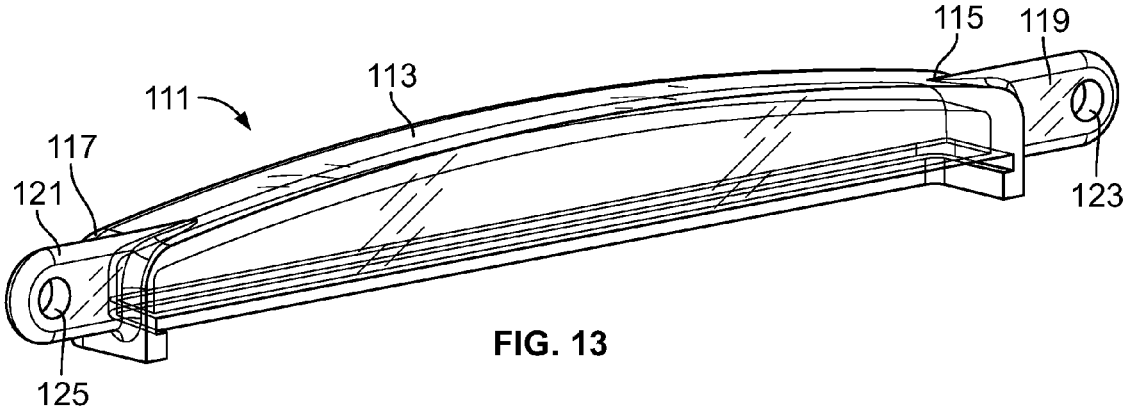
FIG. 13 is a front perspective view of a lens cover according to a second exemplary embodiment of the present invention.
Figure 14:
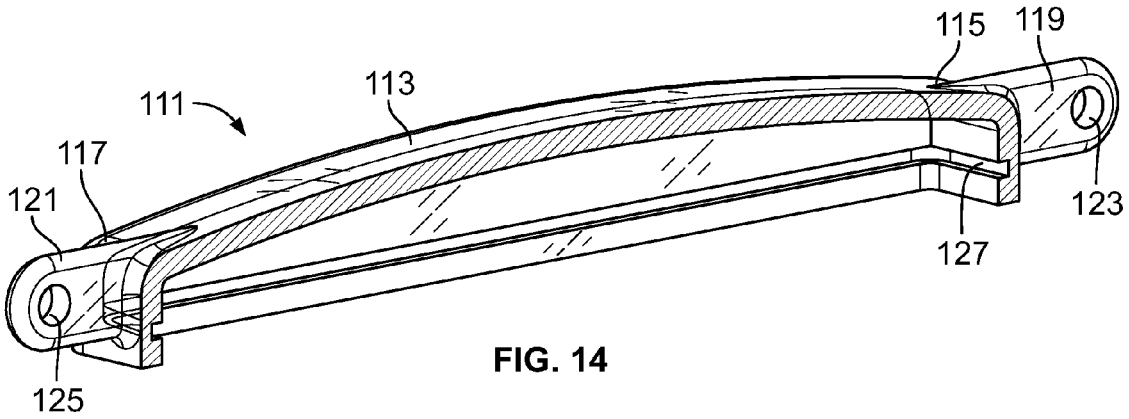
FIG. 14 is a front perspective cross-sectional view of the lens cover shown in FIG. 13.
Figure 15:
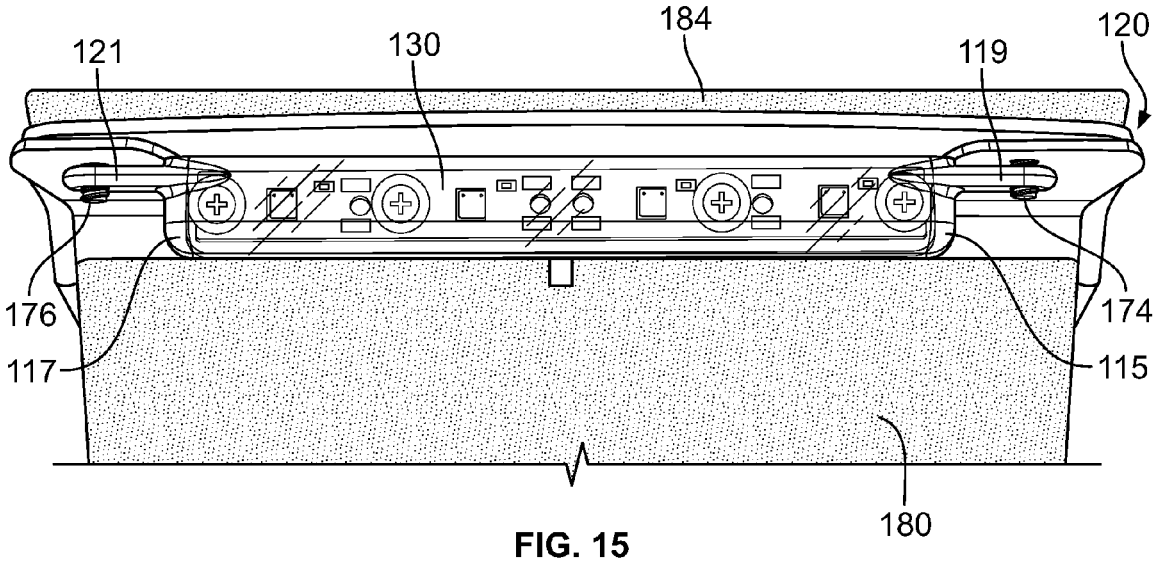
FIG. 15 is a bottom perspective view of the lens cover shown in FIG. 13 installed on the light fixture shown in FIG. 10.

A second exemplary embodiment of the present invention is illustrated in FIGS. 13-15. The elements illustrated in FIGS. 13-15, which correspond to the elements described above with reference to FIGS. 1-12, have been designated by corresponding reference numerals increased by one hundred, while new elements are designated by odd reference numerals in the one hundreds. The embodiment shown in FIGS. 12-15 operates and is constructed in a manner consistent with the embodiment of FIGS. 1-12, unless otherwise indicated.

FIGS. 13 and 14 depict a translucent lens cover 111 according to a second exemplary embodiment of the present invention. The lens cover 111 includes an elongated body 113 having a first end 115 and a second end 117 opposite the first end 115. Cover attaching members 119, 121 extend outwardly from the first and second ends 115, 117, respectively. Cover attaching members 119, 121 include threaded openings 123, 125, respectively, which are adapted to threadingly receive screws 174, 176, respectively, for fixed connection to the attachment module 120. Lens cover 111 includes a channel 127 which runs circumferentially around three sidles of the elongated body 113. The channel 127 is sized and shaped so as to slidingly connect to flange 130 once a light fixture 110 is installed within wall bricks. Referring to FIG. 15, the lens cover 111 is shown connected to the attachment module 120 of the light fixture 110 over the flange 130, and with the screws 174, 176 threadingly inserted into cover the attaching members 119, 121, respectively.

It should be appreciated that the present invention provides numerous advantages. For instance, the shape of the housing 14 and the stop members 66, 68 of the skirt 26 provide a smaller reveal (i.e., overhang or protrusion) for the light fixture 10. Also, the angled construction of the flange 30, the attaching members 32, 34 and the skirt 26, function to project the light away from the wall and towards the center of a path or walkway, as opposed to straight down. This results in a larger illuminating radius for the light fixture 10. The incorporation of the light emitting diode (LED) light bulbs 16*a*, 16*b*, 16*c*, 16*d*, 16*e*, 16*f* provides greater illumination at a fraction of the energy consumption of typical incandescent or fluorescent lamps.

It should be noted that the present invention can have numerous modifications and variations. For instance, the flange 30 can have ruler marks and/or layout guides stamped into it to facilitate the layout and installation of the light fixture 10. Another embodiment may include the skirt 26 and the screws 74, 76 with a faux finish to blend in with its enclosing wall.

It will be understood that the embodiments described herein are merely exemplary and that a person skilled in the art may make many variations and modifications without departing from the spirit and scope of the invention. Accordingly, all such variations and modifications are intended to be included within the scope of the embodiments described and claimed herein.

What is claimed is:

1. A light fixture, comprising an attachment module including a lamp holder, a circuit board having electrically conductive elements, and a skirt, said lamp holder including a substantially flat body, a flange extending angularly from said substantially flat body in a first direction, said flange including an opening and an electrical grommet located within said opening, and a pair of side attachment members, each of which extends angularly from said substantially flat body in a second direction opposite said first direction, each of said pair of side attachment members including a threaded opening, said circuit board being attached to said flange, said skirt including a face plate having a first end, a second end opposite said first end, and a pair of stop members extending substantially perpendicular to said face plate, one of said pair of stop members being located at said first end and the other of said pair of stop members being located at said second end, said face plate having a pair threaded openings, each of which aligns with a corresponding one of said threaded openings of said side attachment members of said lamp holder; and a modular lamp assembly attached to said flange of said attachment module, said modular lamp assembly including a housing having a plurality of light emitting diodes, a light transmitting cover that encloses said plurality of light emitting diodes, and an electrical cord, said plurality of light emitting diodes being connected electrically to said plurality of electrically conductive elements of said circuit board, and said electrical grommet being sized and shaped to receive said electrical cord therethrough.

* * * * *